US008348775B1

(12) United States Patent
Morgan

(10) Patent No.: US 8,348,775 B1
(45) Date of Patent: Jan. 8, 2013

(54) ROTATABLE AMUSEMENT APPARATUS

(76) Inventor: Richard T. Morgan, Scottsdale, AZ (US)

( * ) Notice: Subject to any disclaimer, the term of this patent is extended or adjusted under 35 U.S.C. 154(b) by 298 days.

(21) Appl. No.: 12/916,855

(22) Filed: Nov. 1, 2010

(51) Int. Cl.
*A63G 1/16* (2006.01)
*A63G 1/12* (2006.01)

(52) U.S. Cl. ..... 472/19; 472/20

(58) Field of Classification Search ..... 472/1, 14, 472/19, 20, 135, 136, 137
See application file for complete search history.

(56) References Cited

U.S. PATENT DOCUMENTS

| | | | | | |
|---|---|---|---|---|---|
| 1,693,724 | A | | 12/1928 | Morris | |
| D176,401 | S | * | 12/1955 | Batter | D21/830 |
| 2,804,123 | A | | 8/1957 | Kling | |
| 3,365,194 | A | | 1/1968 | Strickland, Jr. | |
| 3,509,659 | A | | 5/1970 | Kau | |
| 3,785,641 | A | | 1/1974 | Muffly | |
| 5,330,390 | A | * | 7/1994 | Liebert et al. | 472/23 |
| 5,433,682 | A | | 7/1995 | Fermaglich et al. | |
| 5,480,355 | A | | 1/1996 | Miller | |
| 5,720,524 | A | | 2/1998 | Hall | |
| 5,935,010 | A | | 8/1999 | Clarke | |
| 6,319,135 | B1 | * | 11/2001 | Monson | 472/32 |
| 6,342,013 | B1 | * | 1/2002 | Irelan | 472/14 |
| 6,428,451 | B1 | | 8/2002 | Hall | |
| 6,533,672 | B1 | | 3/2003 | Keller et al. | |

* cited by examiner

*Primary Examiner* — Kien Nguyen
(74) *Attorney, Agent, or Firm* — Parsons & Goltry; Michael W. Goltry; Robert A. Parsons

(57) ABSTRACT

An amusement apparatus includes an elongate member having an upper extremity formed with a leveraging arm and an opposed lower extremity formed with a pivot point. A seat to receive a child in a sitting position is mounted to the elongate member for rotation thereabout between the opposed upper and lower extremities, and a handlebar available to be taken up by hand by a child seated on the seat is mounted to the elongate member for rotation thereabout between the seat and the upper extremity. The leveraging arm extends outwardly from the upper extremity to a handled end positioned above the seat. The elongate leveraging arm is available to be taken up at the handled end to reciprocally pivot the elongate member at the pivot point of the lower extremity of the elongate member to impart rotation to the seat about the elongate member.

27 Claims, 8 Drawing Sheets

ROTATABLE AMUSEMENT APPARATUS

FIELD OF THE INVENTION

The present invention relates to amusement devices for children and, more particularly, to an amusement apparatus for supporting and entertaining a child through rotational movement and pivoting movement.

BACKGROUND OF THE INVENTION

Children enjoy playing on riding toys and playground equipment that move cyclical, up and down, or circular motion. The classic teeter totter remains a favorite recreational toy for children. Children enjoy the sensation of jumping off, or being lifted from, the ground. Other toys which enable a child to sit and move in a generally circular manner are also traditional favorites. Children also enjoy bouncing toys including trampolines and large bouncing balls. Children particularly enjoy riding toys which enable them to expend energy. All of these toys provide essential proprioceptic input for developing children.

Existing riding toys including teeter totters and large rotating play devices, however, have a number of drawbacks. Traditional teeter totters require two children of generally equivalent weight to operate. Teeter totters typically provide only pivotal up and down motion about a fulcrum. The fixed up and down motion of the teeter totter typically does not attract a child's attention for a long period of time. Additionally, teeter totters are typically not configured to soften the impact to the child from either end of the teeter totter contacting the ground. This often results in a jarring impact between one child and the ground when the second child lifts off the opposite end of the teeter totter. Rotating toys typically also do not include the ability for the child to move up and down. Additionally, rotating toys are often large, heavy, difficult to operate, difficult to stop and difficult to reverse in direction. Moreover, teeter totters and large rotating riding toys often have unsafe, sharp corners and edges. Some toys have attempted to combine a rotating riding toy with a single child teeter totter. Such devices often have a counterweight assembly dangerously suspended on an opposite end of the teeter totter type rod. The large and heavy counterweight assembly of such toys counteracts the movement of the child riding the toy such that the counterweight assembly swings left or right and up and down creating a safety hazard for children observing or playing nearby. Further, existing riding toys such as teeter totters and large rotatable toys are typically not suitable for home use due to their size and weight, and because such toys are not designed to softly impact the surface upon which the toys rest.

Large bouncing balls provide the ability for a child to bounce up and down and to direct the ball in different directions. However, such balls also are easily rotated, such that the handle rotates toward the surface, which often results in the child falling from the ball. The huge bouncing balls can also be difficult for a child to control and can result in the child inadvertently bouncing in an undesired direction.

Given these and other deficiencies in the art of child amusement devices of the type that may be ridden, the need for continued improvement in the art is evident.

SUMMARY OF THE INVENTION

According to the principle of the invention, an amusement apparatus includes an elongate member having an upper extremity and an opposed lower extremity formed with a pivot point, and which defines a first central axis extending from the upper extremity to the lower extremity. There is a seat to receive a child in a sitting position, which is located at an intermediate location relative to the opposed upper and lower extremities of the elongate member and mounted to the elongate member for rotation about the first central axis. A handlebar is located between the seat and the upper extremity of the elongate member and is mounted to the elongate member for rotation about the first central axis, the handlebar is available to be taken up by hand by a child seated on the seat. An elongate leveraging arm has an inner end affixed to the upper extremity of the elongate member and which extends outwardly and away from the upper extremity of the elongate member to an opposed outer end formed with a handle positioned above the seat and the upper extremity of the elongate member and which defines a second central axis parallel to and spaced from the first central axis of the elongate member. The seat is offset relative to the first central axis, and the elongate leveraging arm is available to be taken up at the handle to reciprocally pivot the elongate member at the pivot point formed in the lower extremity of the elongate member to impart rotation to the seat about the first axis of rotation of the elongate member. The handlebar is mounted to the elongate member for rotation about the first central axis of the elongate member independently of the seat, and for reciprocal movement relative to the seat. The seat is a platform in a preferred embodiment. The pivot point is defined by a resilient boot formed in the lower extremity of the elongate member. An engagement assembly detachably secures the resilient boot to the lower extremity of the elongate member, which includes an engagement element carried by the resilient boot detachably engaging a complemental engagement element carried by the lower extremity of the elongate member. In another embodiment, the pivot point is defined by a pivot joint formed in the lower extremity of the elongate member. The pivot joint consists of a pivot element pivotally received by a complemental pivot element. In a preferred embodiment, the pivot element is a ball, and the complemental pivot element is a corresponding socket formed in a fixture.

According to the principle of the invention, an amusement apparatus includes an elongate member having an upper extremity and an opposed lower extremity formed with a pivot point, and which defines a first central axis extending from the upper extremity to the lower extremity. An intermediate support is carried by the elongate member at an intermediate location relative to the opposed upper and lower extremities of the elongate member. There is a seat to receive a child in a sitting position. The seat is located between the intermediate support and the upper extremity of the elongate member. The seat is further positioned against and supported by the intermediate support and mounted for rotation with respect to the intermediate support about the first central axis of the elongate member. A handlebar is located between the seat and the upper extremity of the elongate member and is mounted to the elongate member for rotation about the first central axis of the elongate member. The handlebar available to be taken up by hand by a child seated on the seat. An elongate leveraging arm has an inner end affixed to the upper extremity of the elongate member and extends outwardly and away from the upper extremity of the elongate member to an opposed outer end formed with a handle positioned above the upper extremity of the elongate member and the seat and which defines a second central axis parallel to and spaced from the first central axis of the elongate member. The seat is offset relative to the first central axis, and the elongate leveraging arm is available to be taken up at the handle to reciprocally pivot the elongate member at the pivot point formed in the lower extremity of the elongate member to impart rotation to the seat about the first axis of rotation of the elongate member. The handlebar is mounted to the elongate member for rotation about the first central axis of the elongate member independently of the seat. In a particular embodiment, the handlebar is mounted to the elongate member for rotation to a buckle carried by the elongate member. The buckle is mounted to the elongate member for reciprocal movement. The seat is mounted for rotation to the elongate member. In another embodiment, the seat is mounted for rotation to the intermediate support, and the intermediate support is, in turn, mounted to the elongate member for reciprocal movement. The seat is a platform in a preferred embodiment. The pivot point is defined by a resilient boot formed in the lower extremity of the elongate member. An engagement assembly detachably secures the resilient boot to the lower extremity of the elongate member, which includes an engagement element carried by the resilient boot detachably engaging a complemental engagement element carried by the lower extremity of the elongate member. In another embodiment, the pivot point is defined by a pivot joint formed in the lower extremity of the elongate member. The pivot joint consists of a pivot element pivotally received by a complemental pivot element. In a preferred embodiment, the pivot element is a ball, and the complemental pivot element is a corresponding socket formed in a fixture.

According to the principle of the invention, an amusement apparatus includes an elongate, substantially rigid pole having an upper extremity and an opposed lower extremity formed with a pivot point, and which defines a first central axis extending from the upper extremity to the lower extremity. An intermediate platform is carried by the pole at an intermediate location relative to the opposed upper and lower extremities of the pole. There is a seat to receive a child in a sitting position. The seat is located between the intermediate support and the upper extremity of the pole. The seat is applied over the intermediate platform, and the seat is positioned against and supported by the intermediate platform and is mounted to the pole for rotation with respect to the intermediate platform about the first central axis of the pole. A handlebar is located between the seat and the upper extremity of the pole and is mounted to the pole for rotation about the first central axis of the pole. The handlebar is available to be taken up by hand by a child seated on the seat. An elongate leveraging arm has an inner end affixed to the upper extremity of the pole and extends outwardly and away from the upper extremity of the pole to an opposed outer end formed with a handle positioned above the upper extremity of the pole and the seat and which defines a second central axis parallel to and spaced from the first central axis of the pole. The seat is offset relative to the first central axis, and the elongate leveraging arm is available to be taken up at the handle to reciprocally pivot the pole at the pivot point formed in the lower extremity of the pole to impart rotation to the seat about the first axis of rotation of the pole. The handlebar is mounted to the pole for rotation about the first central axis of the pole independently of the seat. In a particular embodiment, the handlebar is mounted for rotation to the pole with a collar formed in the handlebar that encircles the pole and that is further captured by the pole for rotation. Preferably, a buckle is carried by the pole between the upper extremity of the pole and the seat, and the handlebar is mounted for rotation to the pole with the collar captured by and encircling the buckle for rotation. The buckle is mounted to the pole for reciprocal movement relative to the seat. The seat overlies and completely covers the intermediate platform. In a particular embodiment, the seat is mounted for rotation to the intermediate platform, and the intermediate platform is mounted to the pole for reciprocal movement. The pivot point is defined by a resilient boot formed in the lower extremity of the pole. An engagement assembly detachably secures the resilient boot to the lower extremity of the pole, which includes an engagement element carried by the resilient boot detachably engaging a complemental engagement element carried by the lower extremity of the pole. In another embodiment, the pivot point is defined by a pivot joint formed in the lower extremity of the pole. The pivot joint consists of a pivot element pivotally received by a complemental pivot element. In a preferred embodiment, the pivot element is a ball, and the complemental pivot element is a corresponding socket formed in a fixture.

BRIEF DESCRIPTION OF THE DRAWINGS

Referring to the drawings.

DETAILED DESCRIPTION

Figure 1:
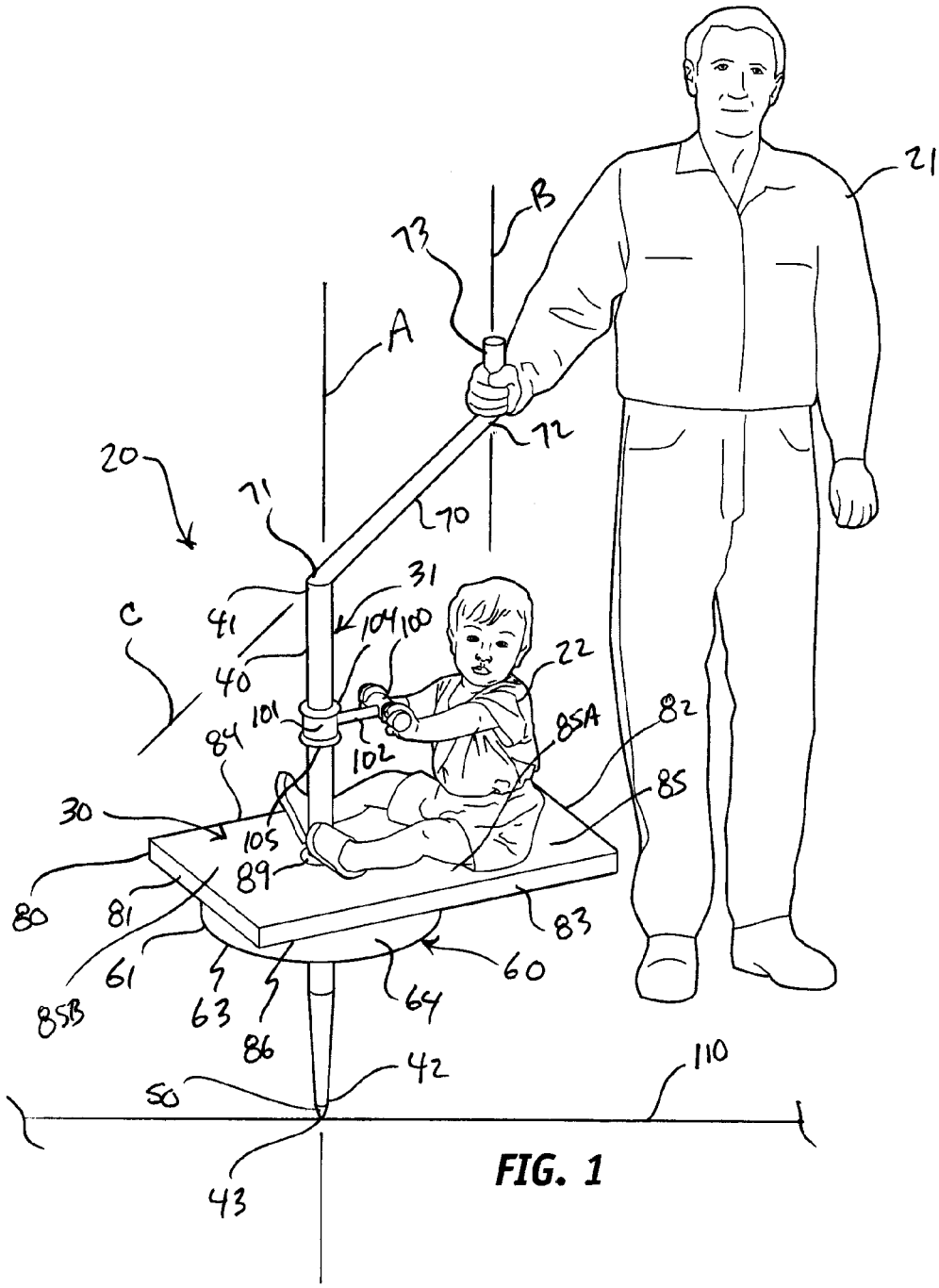
FIG. 1 is a perspective view of an amusement apparatus constructed and arranged in accordance with the principle of the invention and shown as it would appear in use providing amusement to a child.
Figure 2:
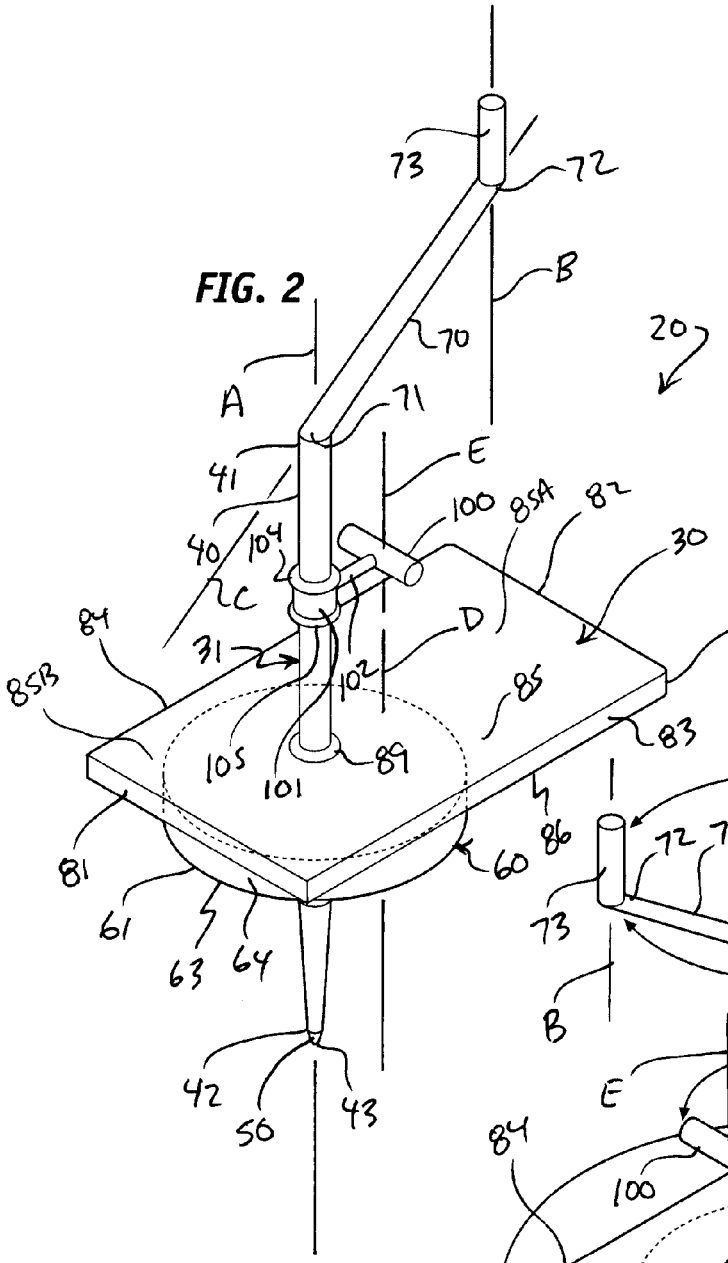
FIG. 2 is a perspective view of the amusement apparatus of FIG. 1.
Figure 3:
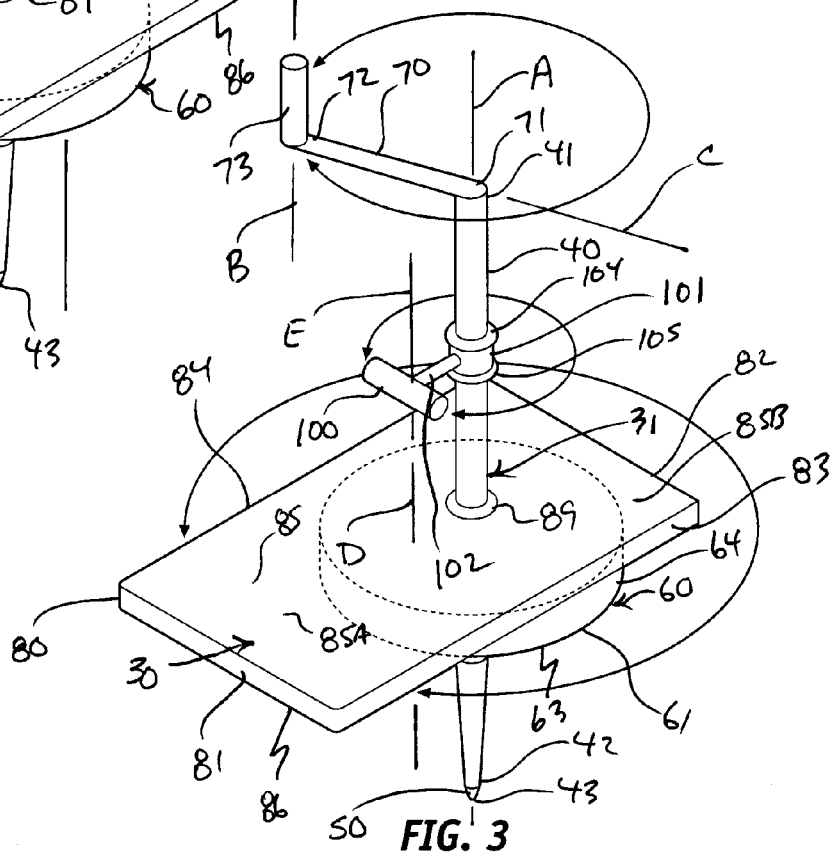
FIG. 3 is another perspective view of the amusement apparatus of FIG. 1 illustrating movement of a seat and a handle with respect to an elongate member of the amusement apparatus.

Turning now to the drawings, in which like reference characters indicate corresponding elements throughout the several views, attention is first directed to FIG. 1 illustrating an amusement apparatus 20 constructed and arranged in accordance with the principle of the invention and shown as it would appear in use by an adult caregiver 21 providing amusement to a child 22 positioned on amusement apparatus 20. Amusement apparatus 20 generally consists of a seat 30 held by and mounted to a handled, manually-operated support assembly 31 for rotation at an elevated location for receiving child 22 in a seated position as shown in FIG. 1 while support assembly 31 is taken up by hand by caregiver 21 and held upright against a support surface 32, whereby caregiver 21 may act on and manage support assembly 31 to rotate and reciprocally pivot support assembly 31 to impart rotation to seat 30 thereabout support assembly 31 to provide delight and amusement to child 22 seated on seat 30.

Referencing in relevant part FIG. 1, FIG. 2, FIG. 3, and FIG. 4, support assembly 31 is used to manage and wield seat 30, is fashioned of wood, plastic, or other substantially rigid, lightweight, strong, rugged, resilient, and impact-resistant material or combination of materials. Support assembly 31 may be integrally formed, such as through machining or molding, or may be formed of a plurality of attached parts joined together with welding, adhesive, fasteners, joinery, etc. Support assembly 31 consists of an elongate member 40 having an upper end or extremity 41, and an opposed lower end or extremity 42. Lower extremity 42 is formed with a pivot point denoted generally at 43. Elongate member 40 is a substantial pole, which is long, strong, slender, and generally cylindrical, which has length extending from upper extremity 41 to pivot point 43 formed in lower extremity 42, and which defines a central axis A extending from upper extremity 41 to lower extremity 43 formed with pivot point 43 about which elongate member 40 is substantially symmetrical. In a preferred embodiment, the length of elongate member 40 from upper extremity 41 to lower extremity 42 formed with pivot point 43 is approximately 36-48 inches.

Figure 6:
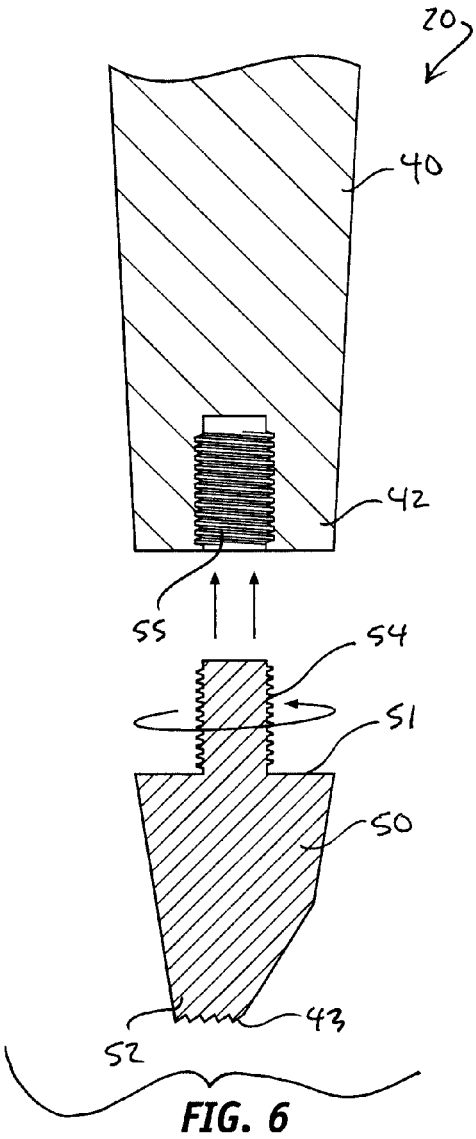
FIG. 6 is an enlarged, fragmented, exploded, vertical section view of a booted end of the amusement apparatus of FIG. 1.
Figure 7:
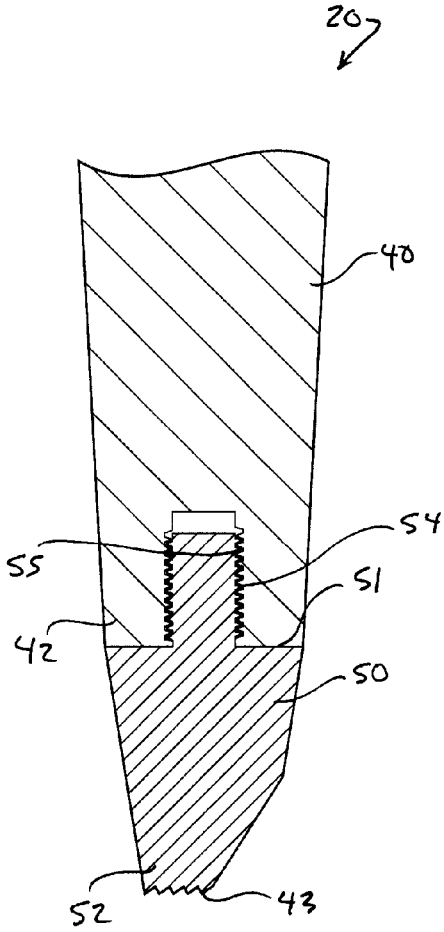
FIG. 7 is a view similar to that of FIG. 6 illustrating the booted end as it would appear assembled.

Looking to FIGS. 6 and 7, pivot point 43 is defined by a resilient boot 50 formed in lower extremity 42 of elongate member 40. Boot 50 is formed of plastic, rubber, such as Vibram brand rubber, neoprene, or other rugged, resilient material or combination of rubber or rubber-like material to provide reliable and prolonged use and life and has an upper end 51 and an opposed lower end 52 defining pivot point 43. Boot 50 is applied to and carried by lower extremity 43 of elongate member 40. Boot 50 is detachably engaged to lower extremity 43 of elongate member 40 with an engagement assembly including an element 54 thereof carried by or otherwise formed in upper end 51 of boot 50, and a corresponding complemental element 55 thereof carried by or otherwise formed in lower extremity 43 of elongate member 40. In the present embodiment, engagement element 54 is a threaded lug that threads into and secures a corresponding threaded socket forming complemental engagement element 55 of the engagement assembly. The threaded lug forming engagement element 54 and the corresponding threaded socket forming the complemental engagement element is exemplary of an engagement pair suitable for forming a rugged, secure coupling between boot 50 and lower extremity 43 of elongate member 40. Although the threaded lug forming engagement element 54 is carried by boot 50 and complemental engagement element 55 is carried by lower extremity 42 of elongate member 40, this arrangement can be reversed is so desired. Those having regard for the art will appreciate the other suitable forms of engagement pairs may be used to releasably and securely attach boot 50 to lower extremity 43 of elongate member 40 without departing from the invention, such as a tongue-and-groove assembly, a pin assembly, etc.

Figure 4A:
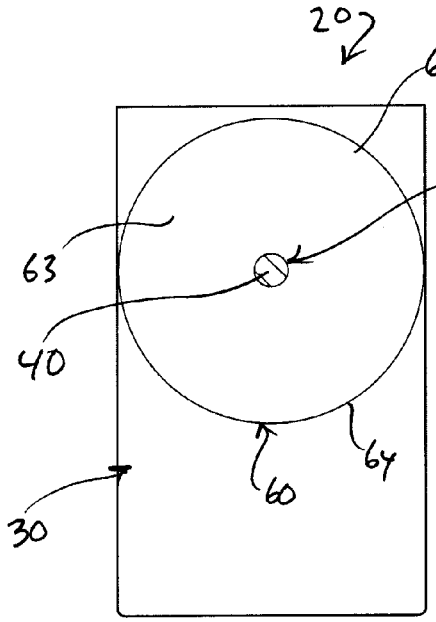
FIG. 4A is a section view taken along line 4A-4A of FIG. 4.
Figure 4:
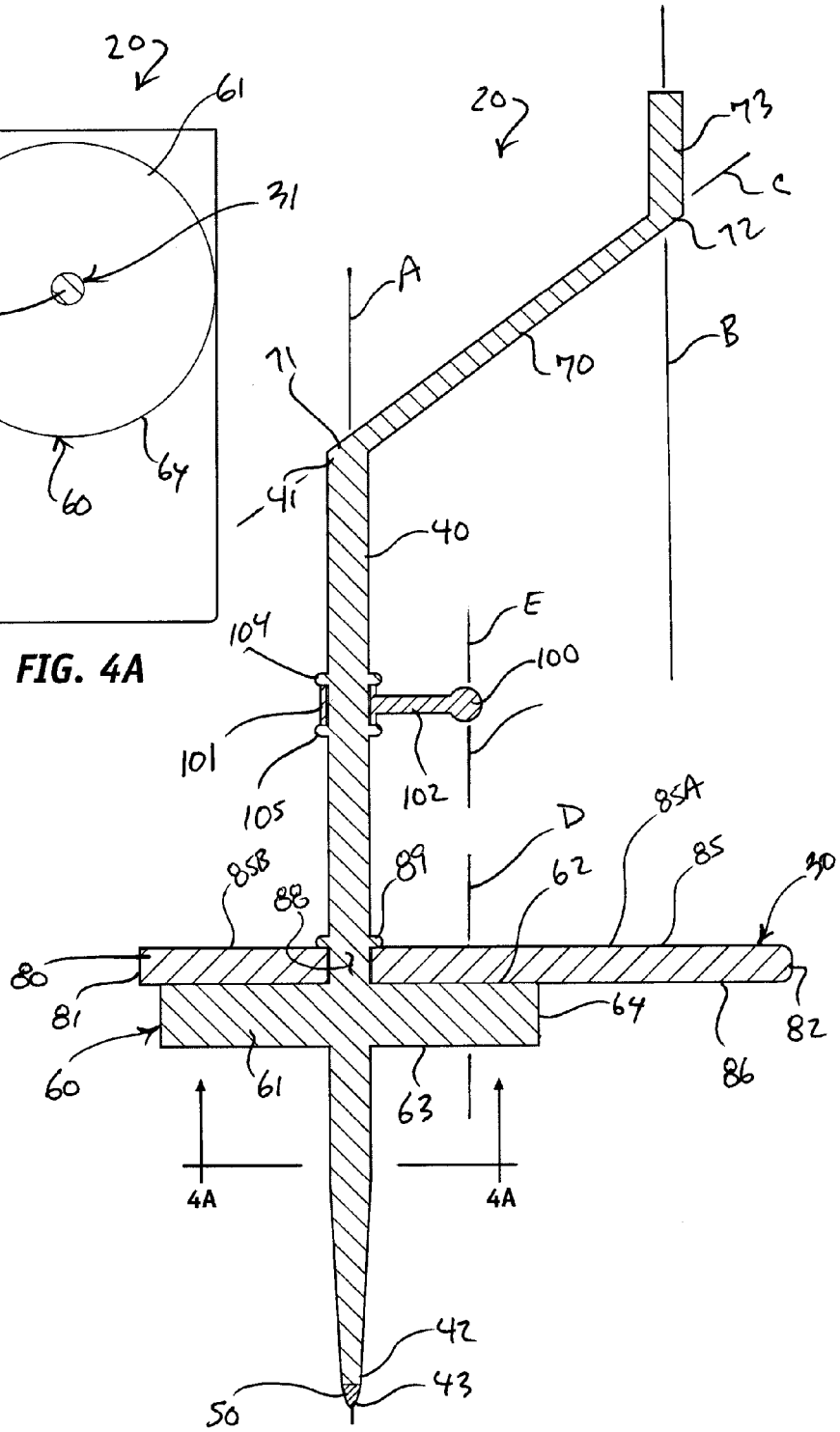
FIG. 4 is a section view taken along line 4-4 of FIG. 2.

Referring back in relevant part FIG. 1, FIG. 2, FIG. 3, and FIG. 4, an intermediate support 60 and a leveraging arm 70 are carried and supported by elongate member 40, and form part of support assembly 31. Support 60, which is also illustrated in FIG. 4A, is mounted to elongate member 40 at an intermediate location relative to opposed upper and lower extremities 41 and 42 of elongate member 40 and, more particularly is positioned somewhat closer to lower extremity 42 of elongate arm than upper extremity 41 of elongate arm as clearly illustrated. Support 60 is rigidly affixed to elongate member 40, and is a broad, substantial platform 61 that encircles elongate member 40, that is substantially symmetrical about axis A of elongate member 40, and which has opposed upper and lower faces 62 and 63, and a perimeter edge 64 which, in this specific embodiment, is generally circular. Upper face 62 is planar being flat and level, and is perpendicular relative to axis A of elongate member 40. Lower face 63 is also planar being flat and level, and is parallel with respect to upper face 62 of platform 61 and is perpendicular with respect to axis A of elongate member 40. Platform 61 forming support 60 is preferably integrally formed with elongate member 40 providing a rigid substantial application and coupling of platform 61 to elongate member 40.

Leveraging arm 70 is elongate and handled, and has an inner end 71 affixed to upper extremity 41 of elongate member 40 and which extends angularly upward, outwardly, and away from upper extremity 41 of elongate member 40 to an opposed outer end 72 formed with a handle 73, which is positioned above upper extremity 41 of elongate member and also support 60. Handle 73 is elongate and suitable to be taken up by hand by a caregiver such as caregiver 21 illustrated in FIG. 1, and defines a central axis B along the length thereof about which handle 73 is substantially symmetrical and that is substantially parallel to and spaced a distance outwardly or otherwise away from axis A of elongate member 40.

Like elongate member 40, arm 70 is a substantial pole, which is long, strong, slender, and generally cylindrical, which has length extending from inner end 71 to outer end 72 formed with handle 73, and which defines a central axis C extending from inner end 71 to outer end 72 about which arm 70 from inner end 71 to outer end 72 is substantially symmetrical and which is up-angled or otherwise angularly disposed upwardly with respect to axis A of elongate member 40 forming an inwardly angle between axis C and axis A of approximately 130 degrees. In a preferred embodiment, the length of arm 70 from inner end 71 to outer end 72 formed with handle 73 is approximately 24-28 inches.

Seat 30 is to receive a child in a sitting position as shown in FIG. 1, and is carried and support by support 31 and elongate member 40. Seat 30 is located at an intermediate location relative to opposed upper and lower extremities 41 and 42 of elongate member 40, and is mounted to rotate about axis A of elongate member 40 such that axis A of elongate member 40 is the axis of rotation of seat 30. In a further and more specific aspect, seat 30 is positioned between support 60 and upper extremity 41 of elongate member 40, and is positioned atop and is received against upper face 62 of platform 61 forming support 60.

Seat 30 is a broad, substantial platform 80 including opposed ends 81 and 82, opposed sides 83 and 84 extending between ends 81 and 82, an upper face 85 to receive and accommodate a child in a seated position as shown in FIG. 1, and an opposed lower face 86. In the present embodiment, ends 81 and 82 are substantially parallel with respect to each other, sides 83 and 84 are substantially parallel with respect to each other and are substantially perpendicular with respect to ends 81 and 82. Ends 81 and 82, and sides 83 and 84 cooperate together to form a perimeter edge of platform 80. Upper face 85 is planar being flat and level, and is perpendicular relative to axis A of elongate member 40. Lower face 86 is also planar being flat and level, and is parallel with respect to upper face 85 and is perpendicular with respect to axis A of elongate member 40. Upper and lower faces 85 and 86 of platform 80 are substantially parallel with respect to upper and lower faces 62 and 63 of platform 61. Platform 80 forming seat 30 defines a central axis D, which is the geometric center of platform 80 about which platform 80 is substantially symmetrical. Referencing FIG. 4, an opening 88 is formed through platform 80. Opening 88 extends through platform 80 from upper face 85 to lower face 86, is positioned between and substantially equidistant with respect to end 81 of platform 80 and axis D of platform 80, and is further positioned between and substantially equidistant with respect to opposed sides 83 and 84 of platform 80.

Elongate member 40 is applied to opening 88, namely, elongate member 40 extends into and through opening 88 from upper face 85 to lower face 86. Lower face 86 of platform 80 is, in turn, received atop and against upper face 62 of platform 61 forming support 60, and platform 80 thus encircles elongate member 40 at opening 88. Lower face 86 of platform 80 is not only received atop and against upper face 62 of support 60, lower face 86 of platform 80 completely overlies and covers support 60 thus isolating upper face 85 of platform 80 onto which a child is to sit from support 60 preventing the toes or fingers of a child sitting upon upper face 85 of platform 80 forming seat 30 from becoming pinched between lower face 86 of platform 80 and upper face 62 of platform 61 as platform 60 rotates about axis A of elongate member 40 across and against and across upper face 62 of platform 61. Elongate member 40 is formed with a stop in the form of an annular abutment 89, which is received in juxtaposition with respect to upper face 85 of platform 80 at opening 88 and captures or otherwise captively retains platform 80 between abutment 89 and upper face 62 of support 60. Platform 80 is free rotate about axis A of elongate member 40 between abutment 89 and support 60 and further with respect to abutment 89, elongate member 40, and support 60 onto which platform 80 forming seat 30 is positioned. As platform 80 rotates 80 it rotates across support 60 in which lower face 86 slides over and across upper face 62 of support 60. And so axis A of elongate member 40 is, as previously mentioned, the axis of rotation of seat 30. To reduce friction between lower face 86 and upper face 62, a lubricant, bearings, or the like may be applied between faces 86 and 62 to provide reduces friction therebetween.

Axis D of platform 80 forming seat 30 is spaced a distance outwardly and away from axis A of elongate member 40, and is positioned between axis A of rotation of seat 30 at elongate member 40 and end 82 of platform 80 forming seat 30. As such, seat 30 formed by platform 80 is offset relative to axis A of elongate member 40. More particularly, axis D of platform 80 being and forming seat 30 and that defines the geometric center of platform 80 and thus seat 30 is parallel to and spaced from axis A of elongate member 40, and this characterizes the offset of platform 80 forming seat 30 relative to axis A of elongate member 40.

Handle 73 formed in arm 70 is located above seat 30 formed by platform 80. The geometric center of platform 80 forming seat 30 defined at axis D is further parallel with respect to axis B of handle 73 and is spaced a distance from axis A of elongate member 40 between axis A of elongate member 40 and the distance of axis B of handle 73 from axis A of elongate member 40. Portion 85A of upper face 85 of platform 80 forming seat 30 between axis A of elongate member 40 and end 82 of platform 80 is substantially greater with respect to opposed portion 85B of upper face 85 of platform 80 between axis A of elongate member and end 81 of platform 80. According to intended use, portion 85A of upper face 85 of platform 80 forming seat 30 between axis A of elongate member 40 and end 82 of platform 80 is the intended seating area of seat 30 for a child in the use of amusement apparatus 20 according to the principle of the invention.

Amusement apparatus 20 is formed with a handlebar 100, which is mounted to elongate member 40 for rotation about axis A of elongate member 40. Handlebar 100 is preferably mounted for rotation to elongate member 40 to rotate independently of seat 30. Handlebar 100 is located between seat 30 and upper extremity 41 of elongate member 40 to allow handlebar 100 to be easily taken up by hand by child 22 seated on portion 85A of upper face 85 of seat 30 formed by platform 80 as shown in FIG. 1. Handlebar 100 is, more particularly, substantially equidistant with respect to upper face 85 of platform 80 forming seat 30 and upper extremity 41 of elongate member 40.

Handlebar 100 is supported at a location that is spaced from axis A of elongate member 40 and resides along vertical plane E that is distanced away from axis A of elongate member 100 substantially equal to the distance of axis D of platform 80 forming seat 30 from axis A of elongate member 40. To rotate handlebar 100 to elongate member 40 in the preferred embodiment, handlebar 100 is connected to a collar 101 with a neck 102 extending therebetween. Collar 101 encircles elongate member 40 between opposed upper and lower stops provided in the form of annular abutments 105 and 106 formed on either side of collar 101. Collar 101 is free to rotate about and with respect to elongate member 40 about axis A of elongate member 40, and is captured or otherwise captively retained to elongate member 40 by and between abutments 104 and 105.

Amusement apparatus 20 is useful in providing amusement and delight to a child, is employed between a child and an adult caregiver, and provides a child and the adult caregiver a unique opportunity for mutual interaction during playtime. To employ amusement apparatus 20, handle 73 is taken up by hand by caregiver 21 in a standing position as shown in FIG. 1, and amusement apparatus 20 is held upright locating pivot point 43 formed in lower extremity 42 against a supporting surface 110. While holding amusement apparatus 20 upright, child 22 is seated onto portion 85A of seat 30 and takes up handle 100 by hand. Child 22 may climb onto seat 30 or be placed onto seat as may be desired. While firmly gripping handle 73 and supporting amusement apparatus 20 in an upright position as shown with child 22 seated on portion 85A of seat 30, caregiver 21 commences to act on amusement apparatus 20 at handle 73 reciprocally pivoting amusement apparatus 20 back and forth at pivot point 43 formed in lower extremity 42 of amusement apparatus 20. Due to the offset orientation of seat 30 with respect to axis of rotation seat 30 defined at axis A of elongate member 40, the described reciprocal pivoting applied to amusement apparatus 20 causes seat 30 supporting child 22 to displace and rotate about axis A of elongate member 40 to provide amusement and fun for child 22. The rotation of handle 100 to elongate member 40 permits handle 100 to rotate about axis A of elongate member 40 as child 22 grips handle 100 and rotates about axis A of elongate member 40 with seat 30 to help prevent child 22 from falling from seat 30. The up-angled orientation of leveraging arm 70 advantageously provides caregiver 21 suitable leverage to reciprocally pivot apparatus 20 at handle 73.

The present invention is described above with reference to a preferred embodiment. However, those skilled in the art will recognize that changes and modifications may be made in the described embodiment without departing from the nature and scope of the present invention. For instance, in amusement apparatus 20 seat 30 and support 60 and handlebar 100 are mounted at fixed positions with respect to elongate member 40. In an alternate embodiment of an amusement apparatus constructed and arranged in accordance with the principle of the invention, support 60 and seat 30 and handlebar 100 may be mounted for movement in reciprocal directions along the length of elongate member 40 to allow for adjustment as needed between them to accommodate children of varying size.

Figure 5:
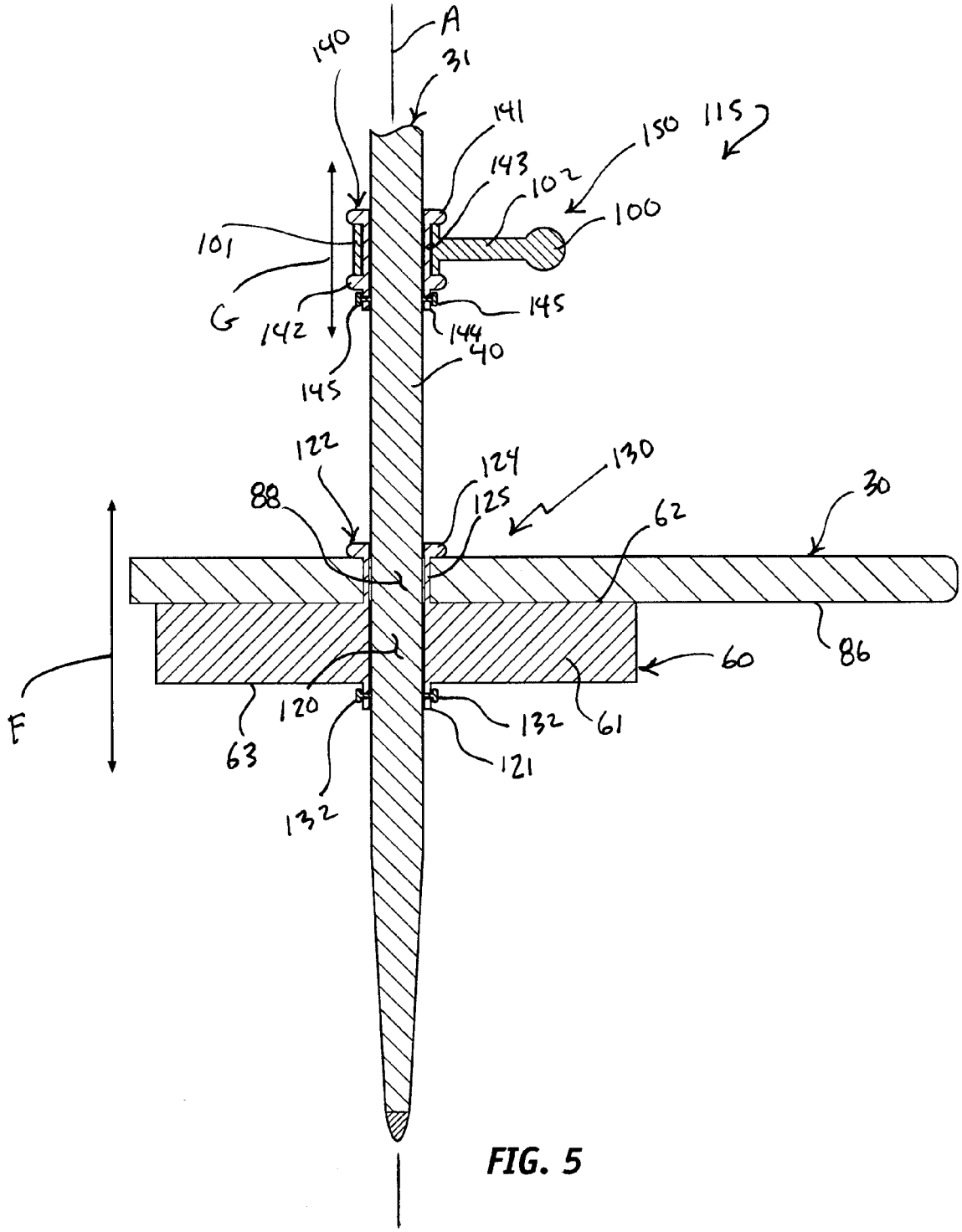
FIG. 5 is a fragmented vertical section view of an alternate embodiment of an amusement apparatus constructed and arranged in accordance with the principle of the invention.

To illustrate this, in FIG. 5 in an alternate embodiment of an amusement apparatus 115 constructed and arranged in accordance with the principle of the invention that in common with apparatus 20 shares support assembly 31 including elongate member 40 and support 60 and seat 30 and handle 100 connected to collar 101 with neck 102 all as previously discussed. In apparatus 115, however, elongate member 40 extends through a central opening 120 formed in platform 61 of support 60 extending from upper face 62 to lower face 63, and which further extends through a flange 121 formed in platform 61 that depends downwardly from lower face 63 of platform 61 that encircles elongate member 40, and through a buckle 122 formed in platform 61 that projects upward from upper face 62 a platform 61 that encircles elongate member 40. Seat 30 is rotated to buckle 122 of platform 61 of support 60 and is thus rotated to or otherwise mounted for rotation to support 60. Buckle 122 consists of a stop in the form of an annular abutment 124, and a collar 125 extending between abutment 124 and upper face 62 of platform 61 of support 60 that together encircle elongate member 40. Lower face 86 of platform 80 forming seat 30 is applied to upper face 62 of support 60 as previously described, and opening 88 encircles collar 125 and platform 80 is free to rotate thereabout collar 125. Abutment 124 is received in juxtaposition with respect to upper face 85 of platform 80 of seat 30 at opening 88 and captures or otherwise captively retains platform 80 to seat 30 between abutment 124 and upper face 62 of support 60 forming in seat 30 and support 60 a seat assembly denoted generally at 130. Platform 80 is free to rotate about axis A of elongate member 40 with respect to abutment 124 and collar 125 and support 60 onto which platform 80 forming seat 30 is positioned.

Flange 121 is formed with set screws 132. Set screws 132 may be loosened freeing seat assembly 130 from elongate member 40 permitting seat assembly 130, including seat 30 rotated to support 60 with buckle 122, in reciprocal directions along the length of elongate member 40 as indicated by the double arrowed line F. After locating seat assembly 130 at a desired location along the length of elongate member 40, set screws 132 may be tightened to secure seat assembly 130 in place in preparation for use of apparatus 130 in the manner described above in connection with apparatus 20.

In apparatus 115, handle 100 is rotated to a buckle 140 mounted to elongate member 40 for movement in reciprocal directions along the length of elongate member 40 as generally indicated by the double arrowed line G. Buckle 140 encircles elongate member 40, and consists of opposed annular abutments 141 and 142 connected by a collar 143 and a flange 144 depending downwardly from abutment 142 that together encircle elongate member 40. Collar 101 encircles collar 143 between opposed abutments 141 and 142 formed on either side of collar 143. Collar 101 is free to rotate about collar 143 and with respect to buckle 140 and elongate member 40 about axis A of elongate member 40, and is captured or otherwise captively retained to collar 143 of buckle 140 by and between abutments 141 and 142 forming a handle assembly denoted generally at 150 consisting of handle 100 mounted for rotation to buckle 140.

Flange 144 is formed with set screws 145. Set screws 145 may be loosened freeing handle assembly 150 from elongate member 40 permitting handle assembly 150, including handle 100 rotated to buckle 140, in reciprocal directions along the length of elongate member 40 as indicated by the double arrowed line G. After locating handle assembly 150 at a desired location along the length of elongate member 40, set screws 1145 may be tightened to secure handle assembly 150 in place in preparation for use of apparatus 1115 in the manner described above in connection with apparatus 20.

Figure 8:
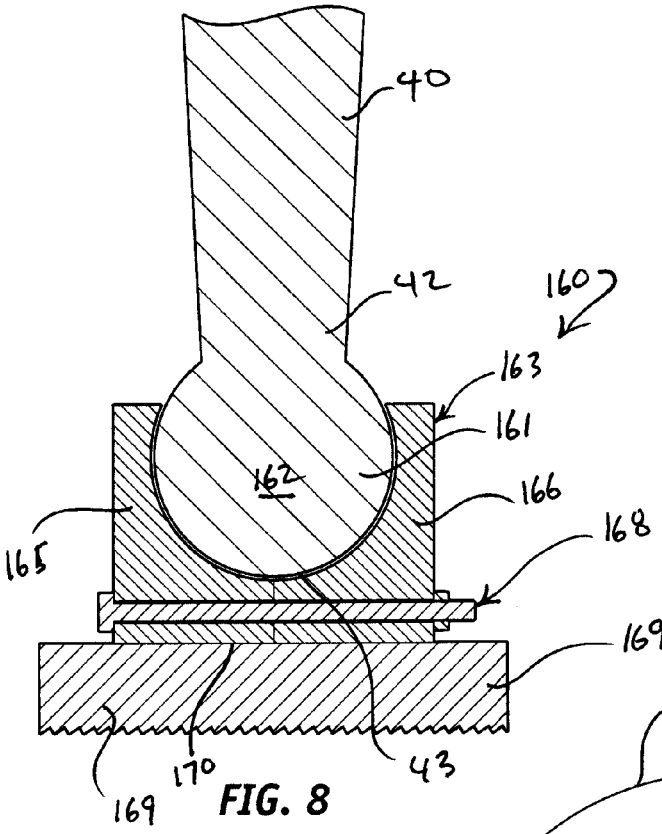
FIGS. 8 and 9 are vertical section views of a jointed end for use with an amusement apparatus constructed and arranged in accordance with the principle of the invention.
Figure 9:
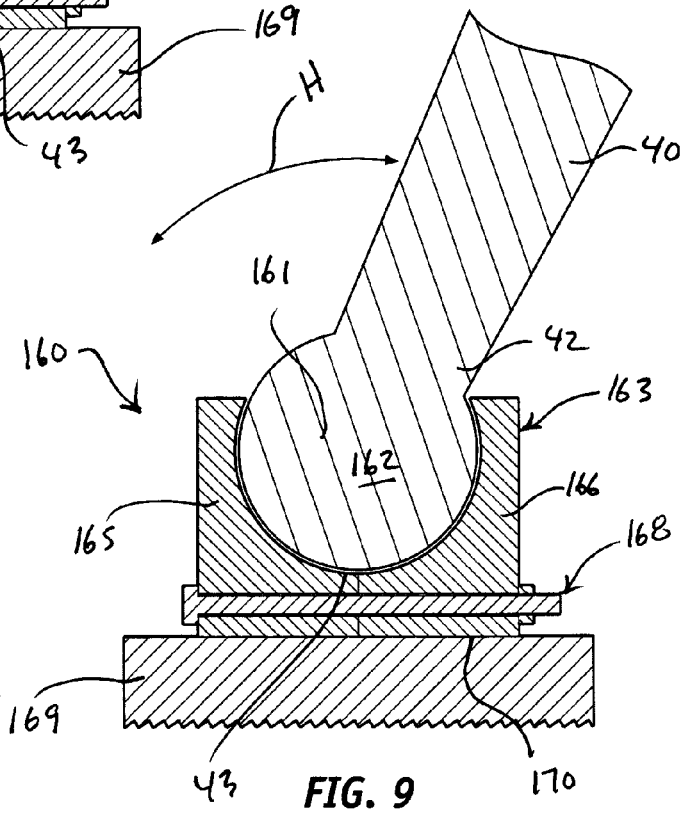

Boot 50 applied to lower extremity 42 of elongate member 40 of apparatus 20 as discussed and illustrated in conjunction with FIGS. 6 and 7 is preferred for forming pivot point 43. FIGS. 8 and 9 demonstrate an alternate embodiment of an assembly cooperating to form pivot point 43. In FIGS. 8 and 9, pivot point denoted generally at 43 formed in lower extremity 42 of elongate member 40 consists of a pivot joint or pivot joint assembly 160 consisting of a ball 161 formed in lower extremity 42 of elongate member 40 pivotally held in or otherwise received by a socket 162 formed in fixture 163. Fixture 163 consists of opposed, interconnected forms 165 and 166 that cooperate to form socket 162. Forms 165 and 166 are fastened together with a fastener denoted generally at 168, which, in the present embodiment, is a nut-and-bolt assembly. A support pad 169 is applied to an underside 170 of fixture 163, and is receivable against a support surface. Pad 169 is preferably secured to underside 170 of fixture 163 with a strong, conventional adhesive. Pad 169 is preferably formed of plastic, rubber, such as Vibram brand rubber, neoprene, or other rugged, resilient material or combination of rubber or rubber-like material to provide reliable and prolonged use and life. Ball 161 is captured in socket 162, and is free to pivot in and with respect to socket 162 as generally indicated by the arcuate, double arrowed line H in FIG. 9 to permit the reciprocal pivoting of elongate member 40 in the use of an amusement apparatus constructed and arranged in accordance with the principle of the invention in the manner described above in connection with apparatus 20.

As previously mentioned, the up-angled orientation of leveraging arm 70 advantageously provides caregiver 21 suitable leverage to reciprocally pivot apparatus 20 at handle 73. Depending on the height of the caregiver using an amusement apparatus constructed and arranged in accordance with the principle of the invention, adjustment of the relative height of handle 73 formed in leveraging arm 70 can be provided in an alternate embodiment of a leveraging illustrated in FIG. 10, FIG. 11, FIG. 12, and FIG. 13.

Figure 10:
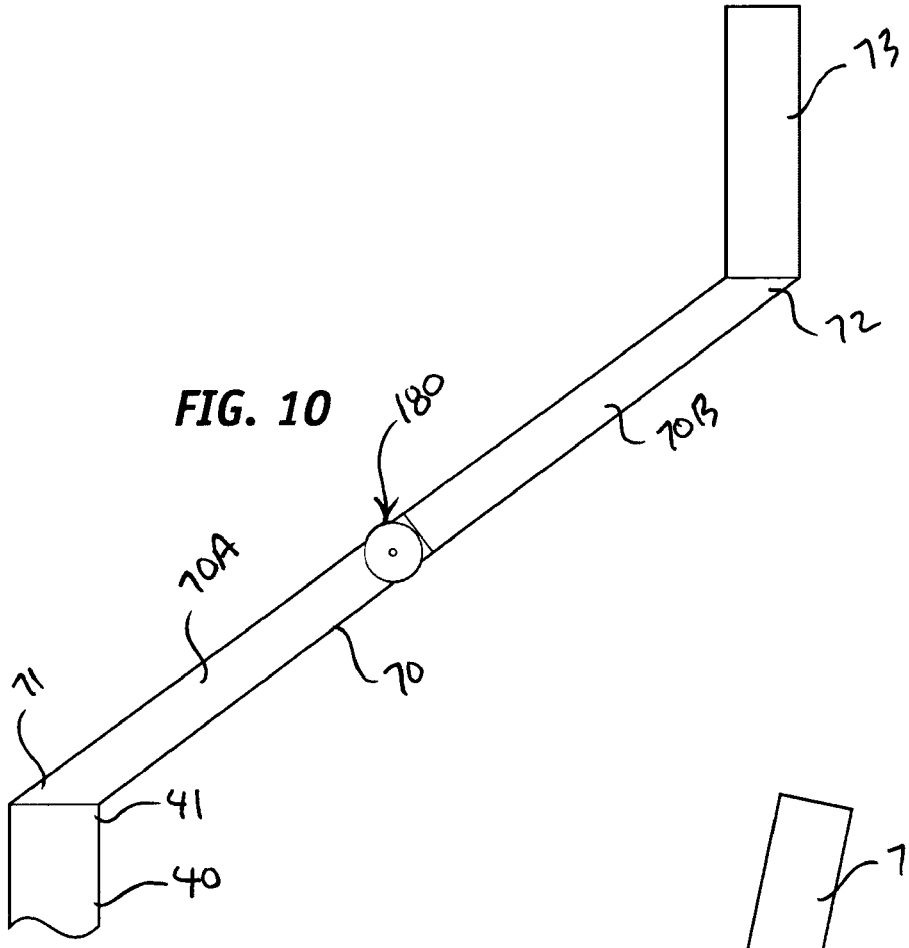
FIGS. 10 and 11 are side elevation views of a handled arm, formed with an adjustable knuckle joint, for use with an amusement apparatus constructed and arranged in accordance with the principle of the invention.
Figure 11:
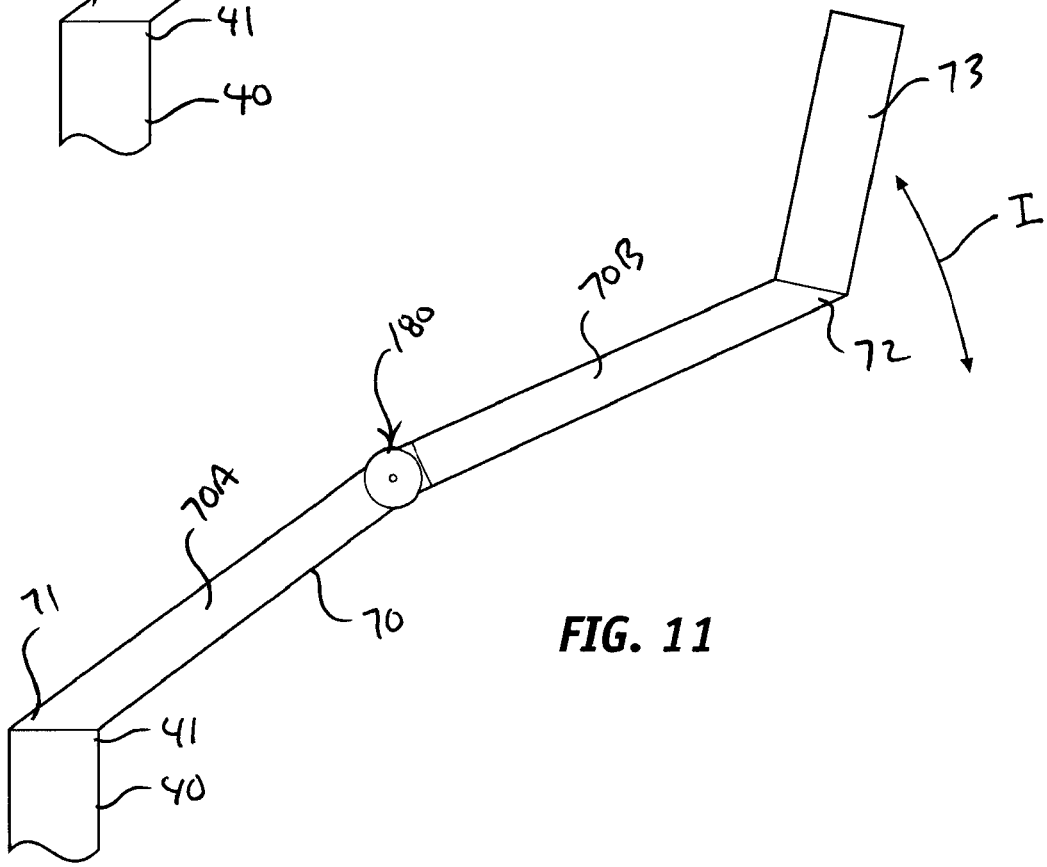

Referencing FIG. 10, leveraging arm 70 has inner end 71 affixed to upper extremity 41 of elongate member 40 and which extends angularly upward, outwardly, and away from upper extremity 41 of elongate member 40 to opposed outer end 72 formed with a handle 73 as previously described in connection with apparatus 20. In FIG. 10, arm 70 is formed with a joint 180. Joint 180 is a knuckle joint formed in arm 70 at an intermediate position with respect to inner and outer ends 71 and 72, and which divides arm 70 into a proximal segment 70A extending from inner end 71 to joint 180, and a distal segment 70B extending from joint 180 to outer end 72 formed with handle 73. Joint 180 may be loosened to release distal segment 70B from proximal segment 70A to permit pivotal movement of distal segment 70B with respect to proximal segment 70A at joint 180 in pivotal directions as generally indicated by the arcuate, double arrowed line in FIG. 11 to permit handle 73 to be raised and lowered as needed to accommodate the particular height of a caregiver using an amusement apparatus constructed and arranged in accordance with the principle of the invention to provide amusement to a child. After pivoting arm 70 to a selected height of handle 73, joint 73 may be locked securing proximal segment 70A to distal segment 70B in preparation for use of the amusement apparatus in the normal manner as described in connection with apparatus 20.

Figure 12:
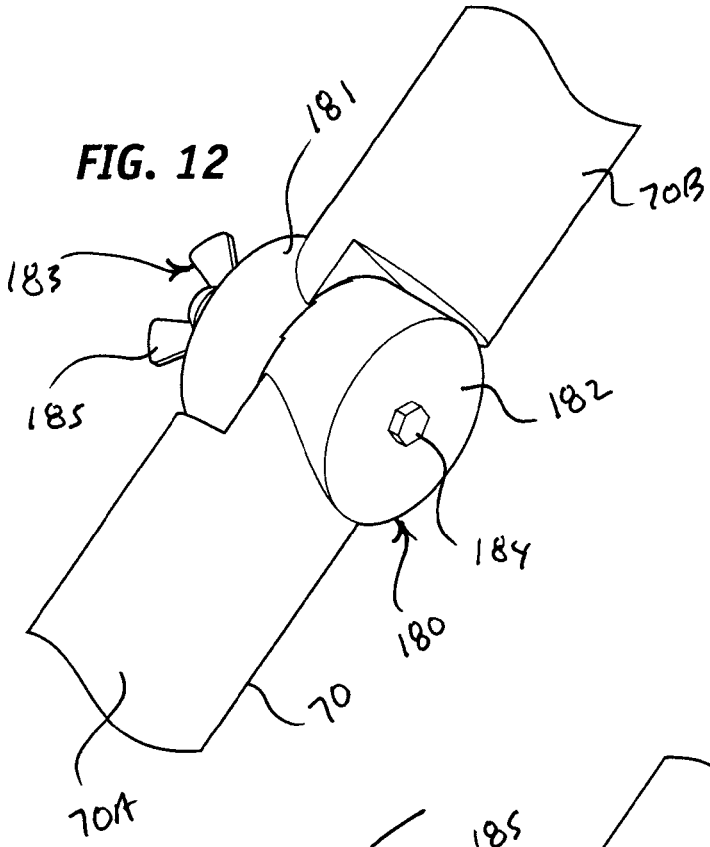
FIG. 12 is an enlarged perspective view of the knuckle joint of FIGS. 10 and 11 shown as it would appear assembled.
Figure 13:
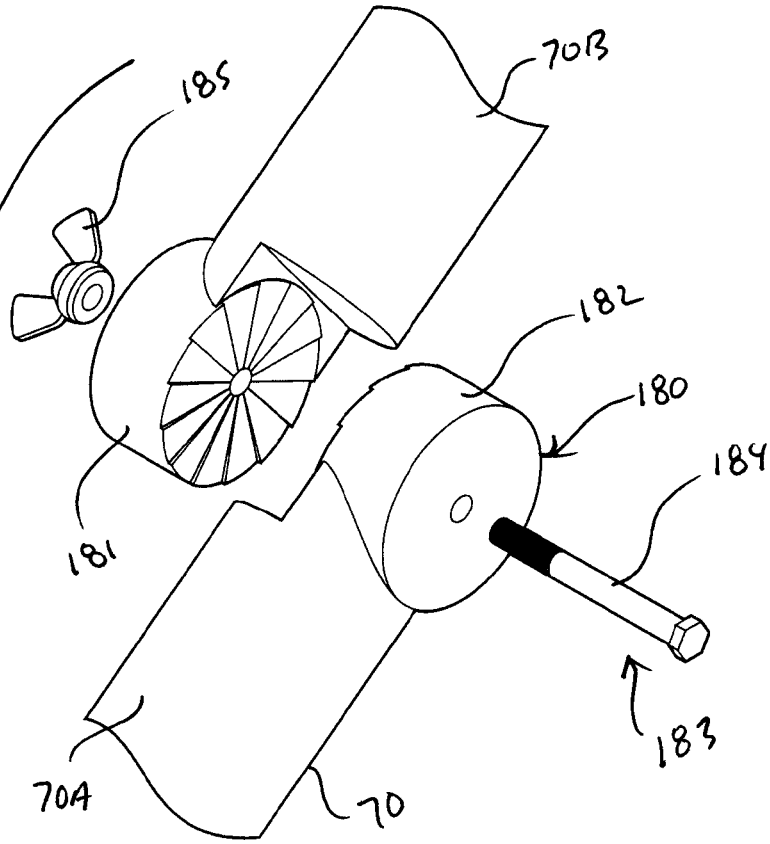
FIG. 13 is an enlarged perspective view of the knuckle joint of FIGS. 10 and 11 shown as it would appear disassembled.

Looking to FIGS. 12 and 13, joint 180 consists of opposed, toothed knuckles 181 and 182 joined with a fastener assembly denoted generally at 183. Fastener assembly 183 consists of a threaded bolt 185 extending concurrently through knuckles 181 and 182 that threadably receives a corresponding threaded wing nut 186. Knuckles 181 and 182 mesh or otherwise meshingly interact when brought together. The meshing interaction between knuckles 181 and 182 when brought together prevents them from rotating or otherwise displacing with respect to each other. FIG. 12 illustrates knuckles 181 and 182 meshingly applied together and fastened secured together with fastener assembly 183. In FIG. 12, bolt 185 extends concurrently through knuckles 181 and 182 and wing nut 186 is threaded onto nut 185 and is tightened securing knuckles 181 and 182 together. Wing nut 186 may be loosened and yet threadably retained on bolt 185 to release knuckles 181 and 182 from one another to permit the pivotal adjustment of distal segment 70B of arm 70 with respect to proximal segment 70A of arm 70 at joint 180 for the purpose of adjusting the relative height of handle 73, after which knuckles 181 and 182 may be meshingly engaged and wing nut 186 tightened to secure knuckles 181 and 182 together as shown in FIG. 12.

Various further changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

The invention claimed is:

1. An amusement apparatus, comprising:

an elongate member having an upper extremity and an opposed lower extremity formed with a pivot point, and which defines a first central axis extending from the upper extremity to the lower extremity;

a seat to receive a child in a sitting position, the seat located at an intermediate location relative to the opposed upper and lower extremities of the elongate member and mounted to the elongate member for rotation about the first central axis;

a handlebar located between the seat and the upper extremity of the elongate member and mounted to the elongate member for rotation about the first central axis, the handlebar available to be taken up by hand by a child seated on the seat;

an elongate leveraging arm having an inner end affixed to the upper extremity of the elongate member and which extends outwardly and away from the upper extremity of the elongate member to an opposed outer end formed with a handle positioned above the seat and the upper extremity of the elongate member and which defines a second central axis parallel to and spaced from the first central axis of the elongate member; and the elongate leveraging arm available to be taken up at the handle to reciprocally pivot the elongate member at the pivot point formed in the lower extremity of the elongate member to impart rotation to the seat about the first axis of rotation of the elongate member.

2. An amusement apparatus according to claim 1, wherein the handlebar is mounted to the elongate member for rotation about the first central axis of the elongate member independently of the seat, and for reciprocal movement relative to the seat.

3. An amusement apparatus according to claim 1, wherein the seat further comprises a platform.

4. An amusement apparatus according to claim 1, wherein the pivot point is defined by a resilient boot formed in the lower extremity of the elongate member.

5. An amusement apparatus according to claim 4, further comprising an engagement assembly detachably securing the resilient boot to the lower extremity of the elongate member including an engagement element carried by the resilient boot detachably engaging a complemental engagement element carried by the lower extremity of the elongate member.

6. An amusement apparatus according to claim 1, wherein the pivot point is defined by a pivot joint formed in the lower extremity of the elongate member.

7. An amusement apparatus according to claim 6, wherein the pivot joint comprises a ball pivotally received by a socket formed in fixture.

8. An amusement apparatus, comprising:

an elongate member having an upper extremity and an opposed lower extremity formed with a pivot point, and which defines a first central axis extending from the upper extremity to the lower extremity;

an intermediate support carried by the elongate member at an intermediate location relative to the opposed upper and lower extremities of the elongate member;

a seat to receive a child in a sitting position, the seat located between the intermediate support and the upper extremity of the elongate member;

the seat positioned against and supported by the intermediate support and mounted for rotation with respect to the intermediate support about the first central axis of the elongate member;

a handlebar located between the seat and the upper extremity of the elongate member and mounted to the elongate member for rotation about the first central axis of the elongate member, the handlebar available to be taken up by hand by a child seated on the seat;

an elongate leveraging arm having an inner end affixed to the upper extremity of the elongate member and which extends outwardly and away from the upper extremity of the elongate member to an opposed outer end formed with a handle positioned above the upper extremity of the elongate member and the seat and which defines a second central axis parallel to and spaced from the first central axis of the elongate member; and the elongate leveraging arm available to be taken up at the handle to reciprocally pivot the elongate member at the pivot point formed in the lower extremity of the elongate member to impart rotation to the seat about the first axis of rotation of the elongate member.

9. An amusement apparatus according to claim 8, wherein the handlebar is mounted to the elongate member for rotation about the first central axis of the elongate member independently of the seat.

10. An amusement apparatus according to claim 9, wherein the handlebar is mounted to the elongate member for rotation to a buckle carried by the elongate member.

11. An amusement apparatus according to claim 10, wherein the buckle is mounted to the elongate member for reciprocal movement.

12. An amusement apparatus according to claim 8, wherein the intermediate support is mounted to the elongate member for reciprocal movement.

13. An amusement apparatus according to claim 8, wherein the seat further comprises a platform.

14. An amusement apparatus according to claim 8, wherein the pivot point is defined by a resilient boot formed in the lower extremity of the elongate member.

15. An amusement apparatus according to claim 14, further comprising an engagement assembly detachably securing the resilient boot to the lower extremity of the elongate member including an engagement element carried by the resilient boot detachably engaging a complemental engagement element carried by the lower extremity of the elongate member.

16. An amusement apparatus according to claim 8, wherein the pivot point is defined by a pivot joint formed in the lower extremity of the elongate member.

17. An amusement apparatus according to claim 16, wherein the pivot joint comprises a ball pivotally received by a socket formed in fixture.

18. An amusement apparatus, comprising:

an elongate, substantially rigid pole having an upper extremity and an opposed lower extremity formed with a pivot point, and which defines a first central axis extending from the upper extremity to the lower extremity;

an intermediate platform carried by the pole at an intermediate location relative to the opposed upper and lower extremities of the pole;

a seat to receive a child in a sitting position, the seat located between the intermediate support and the upper extremity of the pole;

the seat applied over the intermediate platform, and positioned against and supported by the intermediate platform and mounted to the pole for rotation with respect to the intermediate platform about the first central axis of the pole;

a handlebar located between the seat and the upper extremity of the pole and mounted to the pole for rotation about the first central axis of the pole, the handlebar available to be taken up by hand by a child seated on the seat;

an elongate leveraging arm having an inner end affixed to the upper extremity of the pole and which extends outwardly and away from the upper extremity of the pole to an opposed outer end formed with a handle positioned above the upper extremity of the pole and the seat and which defines a second central axis parallel to and spaced from the first central axis of the pole; and the elongate leveraging arm available to be taken up at the handle to reciprocally pivot the pole at the pivot point formed in the lower extremity of the pole to impart rotation to the seat about the first axis of rotation of the pole.

19. An amusement apparatus according to claim 18, wherein the handlebar is mounted to the pole for rotation about the first central axis of the pole independently of the seat.

20. An amusement apparatus according to claim 19, wherein the handlebar is mounted for rotation to the pole with a collar formed in the handlebar that encircles the pole and is captured by the pole for rotation.

21. An amusement apparatus according to claim 19, further comprising:

a buckle carried by the pole between the upper extremity of the pole and the seat; and the handlebar formed with a collar and mounted for rotation to the pole with the collar captured by and encircling the buckle for rotation.

22. An amusement apparatus according to claim 21, wherein the buckle is mounted to the pole for reciprocal movement relative to the seat.

23. An amusement apparatus according to claim 18, wherein the seat is offset relative to the first central axis of the pole.

24. An amusement apparatus according to claim 23, wherein the seat overlies and completely covers the intermediate platform.

25. An amusement apparatus according to claim 18, wherein the intermediate platform is mounted to the pole for reciprocal movement.

26. An amusement apparatus according to claim 18, wherein the pivot point is defined by a resilient boot coupled to the lower extremity of the pole.

27. An amusement apparatus according to claim 18, wherein the pivot point is defined by a pivot joint formed in the lower extremity of the pole comprising a pivot element pivotally received by a complemental pivot element.

* * * * *